United States Patent [19]

Kalinowski

[11] 3,983,706

[45] Oct. 5, 1976

[54] MARINE STRUCTURE WITH HYDRAULIC TENSIONER

[75] Inventor: David W. Kalinowski, Metairie, La.

[73] Assignee: Texaco Inc., New York, N.Y.

[22] Filed: July 10, 1975

[21] Appl. No.: 594,923

[52] U.S. Cl. ..... 61/98; 166/.5; 175/7

[51] Int. Cl.[2] ..... B63B 35/44

[58] Field of Search ..... 61/46, 46.5; 114/.5 D; 175/7; 166/.5, .6

[56] References Cited

UNITED STATES PATENTS 3,817,325 6/1974 Meta et al. ..... 166/.5

3,902,843 9/1975 Gemm et al. ..... 61/46.5

*Primary Examiner*—Paul R. Gilliam
*Assistant Examiner*—Alexander Grosz
*Attorney, Agent, or Firm*—T. H. Whaley; C. G. Ries; Robert B. Burns

[57] ABSTRACT

A tension leg marine structure or working platform is floatably positioned above an offshore working site, being maintained in place by a plurality of tension cables that connect to anchors at the sea floor. A riser which extends between the structure and the sea floor is laterally supported by a hydraulic tensioning system adapted to be adjusted in conformance with the platform's and the riser's movement.

7 Claims, 4 Drawing Figures

MARINE STRUCTURE WITH HYDRAULIC TENSIONER

BACKGROUND OF THE INVENTION

In the exploration and drilling for offshore oil and gas wells, one form of marine structure found to be desirable and effective is the tension leg platform. In this type unit, the working structure is floatably supported by its own buoyancy. However, tension cables applied to the lower end of the platform and fixed to the ocean floor, allow it to be drawn downwardly to a desired working depth.

Under such conditions the structure is less susceptible to natural forces such as wind and waves which would otherwise tend to displace and disturb the horizontal orientation of the platform with respect to the ocean floor.

In the drilling of offshore wells, it is necessary to utilize a riser, often referred to as a marine riser, which extends from the well head to the working deck of the floating platform. The riser member is in effect an elongated enclosure which surrounds and protects the drill string as well as pipes which pass from the well upwardly to the platform deck.

Such risers are necessary for normal drilling operations but are susceptible to damage and in many cases to breakage. The latter results from excessive strain applied to the riser as the floating platform vacillates about its working position in response to excessive wind and wave conditions at the water's surface.

Further, the riser is subjected to a considerable stress induced by water currents and the like which pass around the riser, but which are not particularly effective against the platform. In such an instance the normally vertical riser disposition tends to be distorted as the latter is displaced laterally in one or more directions in response to underwater currents.

In the presently disclosed arrangement, the elongated riser of the type contemplated is provided with means directly attached to the tension leg platform such that the disposition and distortion of the riser is readily controlled. The control means includes an adjustable connection which extends from the centrally placed riser, outwardly toward the respective tension or hold-down cables. Thus, as the riser is subjected to deflecting forces the connection is adjusted either automatically or as required to regulate the disposition of the riser.

It is therefore an object of the invention to provide means for supporting a marine riser from a floating tension leg platform positioned at an offshore body of water. A further object is to avoid damage to such a marine riser which would occur if the riser were to be excessively stressed as a result of underwater currents and forces acting thereagainst. Another objective is to provide means for regulating the disposition and alignment of a marine riser through suitable adjustment thereof in a controlled manner from the deck of the floating platform.

Toward achieving the above objectives and toward overcoming the herein mentioned problems, the invention is directed to a riser connection system adapted to cooperate with a floating, tension leg type marine structure. The system forms an adjustable interconnection between the structure and the marine riser. The riser connection system includes means for regulating the resisting forces applied to a riser as the latter is deflected from its desired upright disposition.

DESCRIPTION OF THE DRAWINGS

Referring to FIG. 1, a floating tension leg platform 10 or marine structure of the type contemplated is found to be both practical and desirable for offshore drilling, exploratory and storage work. The platform embodies the advantage of being less susceptible to disruptive forces caused by wind and surface wave conditions, thus assuring continuous drilling operations in spite of the weather.

Figure 1:
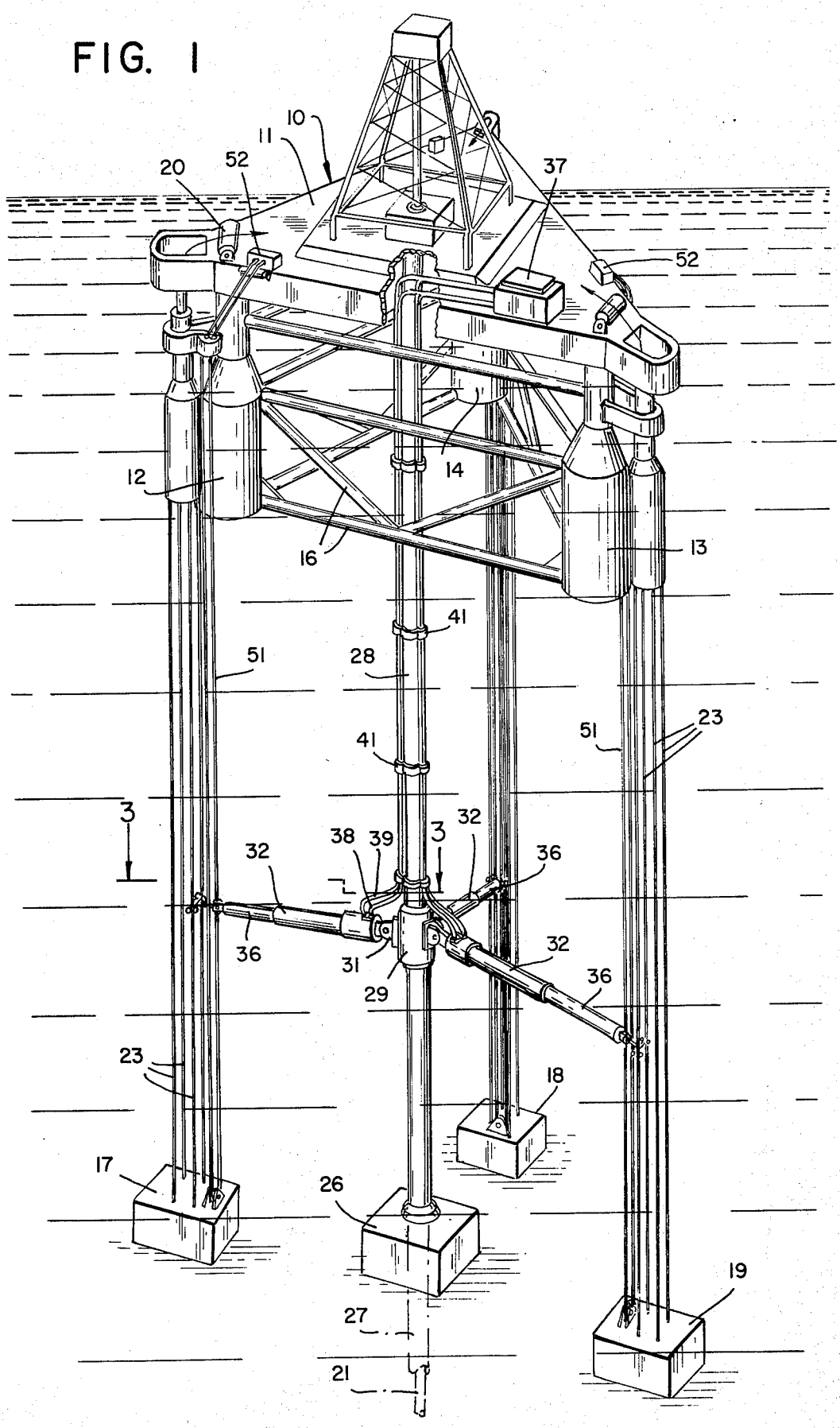
FIG. 1 is an elevation view of the present offshore platform shown in the submerged position being anchored to the ocean floor.

Functionally, platform 10 includes a working deck 11 which is normally positioned 50 to 60 feet above the water's surface. A plurality of downwardly extending controllably buoyant members or legs 12, 13 and 14 are supportably connected at their upper ends to the deck 11 thereby maintaining the unit at a desired level in the water. The respective buoyant members are normally of sufficient tank capacity that deck 11 can be raised or lowered as desired through the use of a suitable control system, for either transporting the structure, or for positioning it at a working site.

While not shown in detail, the respective buoyant members are further provided with cross bars 16 and other necessary understructure to rigidize the unit.

To provide the necessary stability, a plurality of anchors 17, 18 and 19, normally a minimum of three, are disposed at the ocean floor about the site where a well 21 is to be drilled. These anchors are preferably positioned to be directly beneath the platform 10 and are arranged peripherally about the proposed well head.

Each anchor, such as 17, is firmly embedded into the ocean floor by piling in the usual manner. However, if the anchor is of sufficient weight it can maintain its position in spite of upward forces acting thereagainst.

Anchor 17 is provided at its upper surface with cable holding rings or the like such as cable directing members or pulleys through which a hold-down cable 23 is wound. In any instance anchor 17 is adapted to receive a plurality of the tension members 23 which can be in the form of individual steel cables. The latter of course extend through the water between the anchor 17 and floating structure 10.

As mentioned, each floor positioned anchor is preferably provided with a pluraltiy of the hold-down cables 23. In the instant embodiment, at least four are shown extending from each anchor 17, upwardly to deck 11. The respective cable ends are connected to a cable take-up mechanism 20 on deck 11, which is adapted to adjust the cable tension and thus regulate the floating position of the structure. Ideally, the cables should extend in a substantially vertical direction between their upper and lower points of connection. While this disposition is preferred, its absence would not preclude use of the present riser control system. For example, the respective cables 23 can be canted to one side by displacement of the platform, or the anchors, and still serve the function for which they were designed.

Functionally, and prior to a well drilling operation, at such time as marine structure 10 is positioned above a drilling site it is buoyed to a desired level by regulation of the respective legs 12, 13 and 14. Thereafter, the respective cables 23 are attached to preplaced anchors 17, 18 and 19 at the ocean floor, and are reeled in or tensioned such that platform 10 is uniformly drawn deeper into the water although being buoyed upwardly by the same forces applied through the respective legs. At a predetermined working depth, the cable tensioning operation is terminated.

Figure 2:
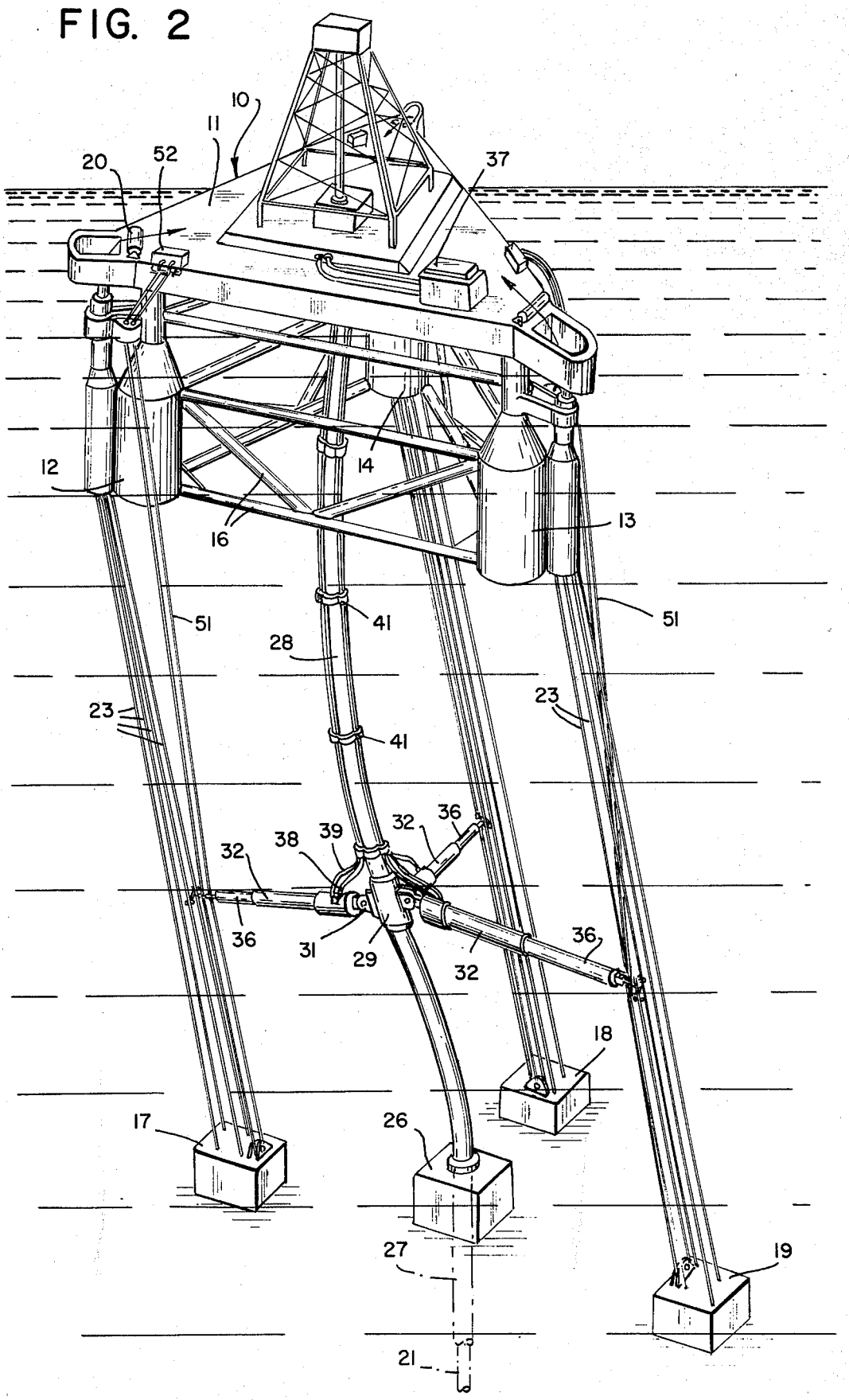
FIG. 2 is an alternate illustration of FIG. 1 showing the platform in a displaced position.
Figure 3:
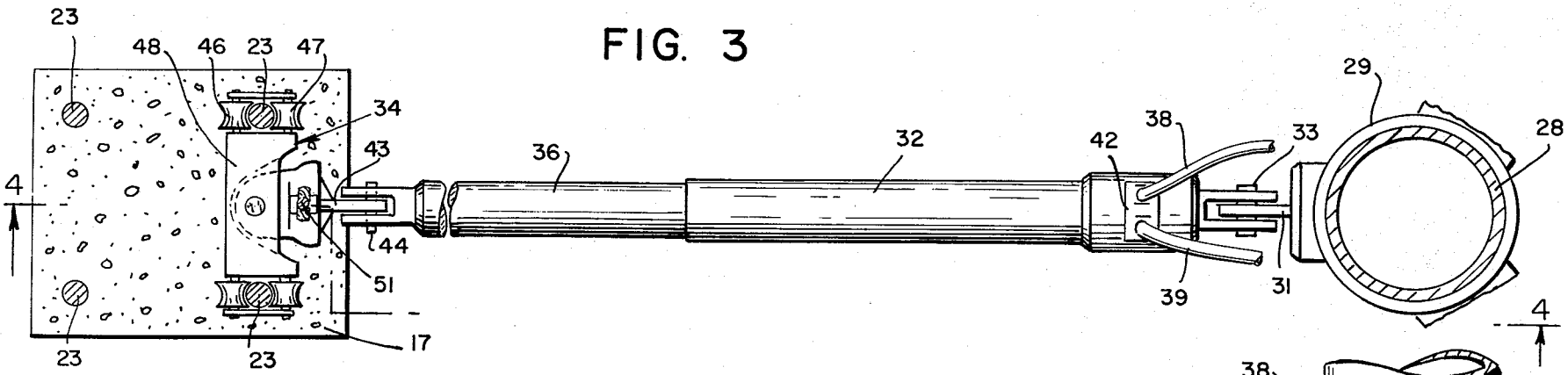
FIG. 3 is an enlarged cross sectional view taken along line 3—3 in FIG. 1.
Figure 4:
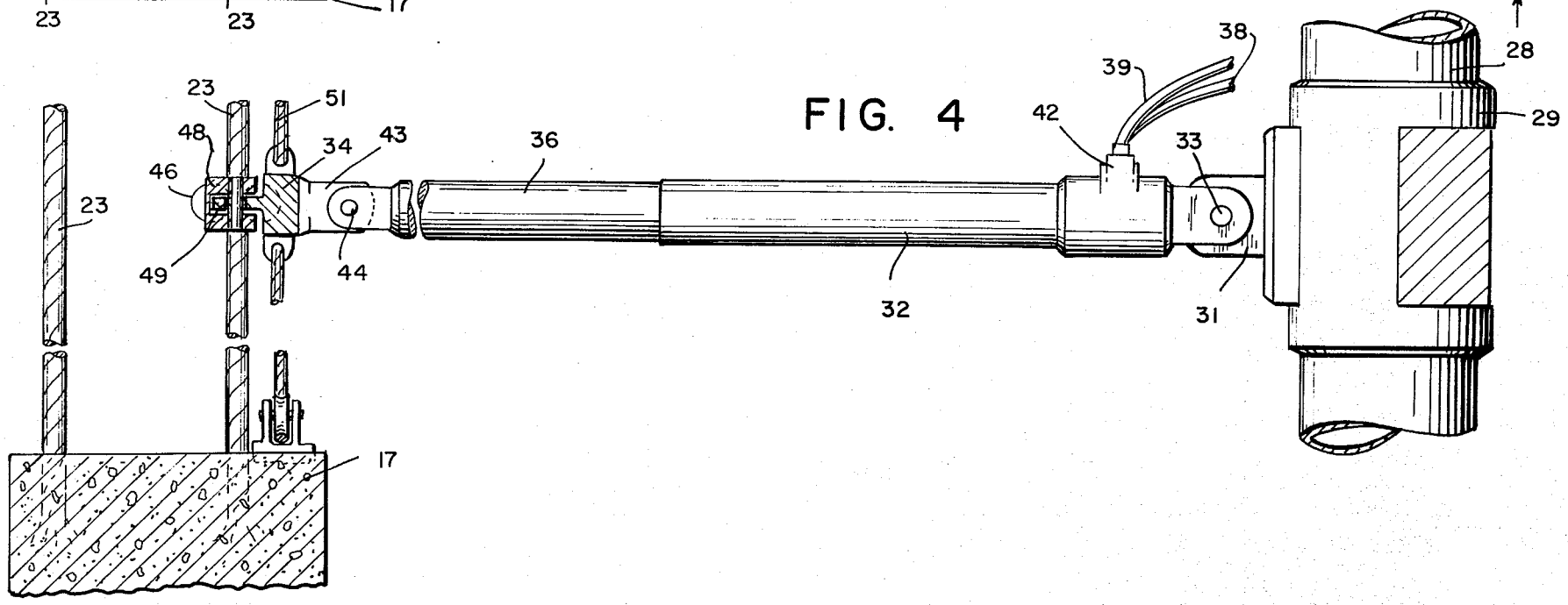
FIG. 4 is a side elevation of FIG. 3.

As presently positioned, and referring to FIG. 2, platform or structure 10 is in effect tethered such that it can experience limited horizontal movement. Such movement will embody a degree of vertical displacement. Thus, when subjected to a displacing force, the floating structure will be moved laterally in an amount permitted by restraining cables 23, and contingent on the platform's buoying force.

Normally, after platform 10 is positioned at a working site, the basic well head equipment is installed. The latter is preferably embedded beneath the marine structure 10 such that a drill string, supported from platform deck 11, can be readily inserted and reinserted into the well head for a drilling operation. As presently shown, the normal well head equipment includes a base member 26 through which a number of casing members 27 are passed and supported. The usual Christmas tree arrangement and control member, although not shown, are also included in the base to regulate the drilling operation insofar as fluid flow is concerned.

Base 26 is further provided with a suitable connector adapted to operably engage the lower end of a drilling riser 28 at a removable connector coupling.

Riser member 28 comprises an elongated tubular unit of sufficient diameter to permit at least a drill string to pass downwardly therethrough and to conduct drilling fluid from the well to the platform deck 11. Normally riser 28 is fabricated of a series of short tubular steel members which are end welded or bolted during installation to form a single continuous length. The riser is terminally fastened in such manner at both the well head and at the drilling deck 11, such that a drill string is readily inserted thereinto to perform a drilling operation.

As presently shown, the lower end of riser 28 is pivotally connected at the well head to allow a limited amount of relative movement therebetween as platform 10 is displaced from its desired location above the well head.

As herein mentioned, a considerable amount of difficulty has been experienced with floating offshore structures of the type contemplated particularly in the use of such structures in deep water. Notably, such difficulties are prompted when platform 10 is displaced excessively, or when it is subjected to extreme movement due to weather conditions on the water's surface. Thus, and as herein noted, riser 28 is susceptible to both damage and to breakage.

To lessen the strain on riser 28 during a drilling operation, and to force the riser into a desired configuration, the present riser system is employed. The latter includes primarily adjusting means for connecting centrally positioned riser 28 to the respective tensioning cables 23, located radially therefrom. The respective hold-down cables will thus function to resist movement of the riser in such manner to absorb any sudden shock or excessive stress which might otherwise be imposed.

Riser 28 is provided with a collar or ring 29 which firmly engages and encircles the riser 28 outer surface. While but a single ring 29 is presently shown it is understood that a series of such rings or even appropriately positioned fastening lugs can be applied to the riser exterior. Placement of collar 29 is normally done during the riser placement period such that the riser adjusting system will act along a series of longitudinally spaced stabilizing levels. In the instant embodiment, collar 29 includes a plurality of outwardly protruding fastening lugs 31 which are peripherally spaced one from the other to permit the desired number of riser adjusting members 32 to be incorporated into the structure.

Each mounting lug 31 includes a center opening adapted to receive a connecting pin 33 in such a manner to permit movement of hydraulic cylinder 32 in a plane normal to the riser 28 longitudinal axis.

The respective hydraulic cylinders 32 are shown as being operably positioned at one extremity by collar 29, and extending radially outwardly from the riser 28. The other extremity engages a mounting base or carriage 34 disposed on the tensioning cables.

In the present embodiment the riser adjusting member 32 includes a hydraulic cylinder of the type generally utilized in the industry. Structurally it comprises an elongated hydraulic cylinder. A piston 36 is slidably mounted within the cylinder to permit longitudinal motion therewith. The piston further includes a piston rod which extends from the cylinder end.

Sealing means is carried on the cylinder to permit the piston to slide therethrough as a result of fluid being pumped into the cylinder under relatively high pressure thereby affecting piston movement.

A hydraulic system is communicated with each hydraulic cylinder 32 and includes a source of hydraulic fluid 37 such as a reservoir, which is normally positioned above the water at deck 11. Fluid is conveyed to the respective cylinders 32 through individual lines or conduits 38 and 39 to permit individual operation of each unit. Said lines 38 and 39 are preferably supported at the riser 28 by spaced apart brackets 41 and may be either a conduit or flexible. The lower ends of the respective fluid conduits are threadably engaged with the hydraulic cylinder at a terminal box 42.

In that the operation of hydraulic cylinders 32 presently shown follows the basic function of similar such cylinders, and is well known in the art, a description of the workings of the cylinder is unnecessary. However, it is appreciated that the respective ends of the cylinder 32 are separated by the piston 36 contained therein. Conduits 38 and 39 extending to the cylinder are normally arranged to communicate with suitable valving so that the hydraulic fluid is pumped into, or removed from the cylinder in accordance with the adjustment to be made on riser 28. The remote end of the cylinder 32 includes a piston rod 36 which is provided with a fastening means adapted to operably engage a coupling 43 on the vertically adjustable carriage 34. A pivot pin 44 engages piston rod 36 with carriage 34 at coupling 43 to allow movement of the cylinder 32 to a desired disposition.

Each set of tensioning cables 23 is provided with a carriage 34 at which one end of hydraulic cylinder 32 is supportably mounted. Each carriage 34 is vertically displaceable along the respective tensioning cables 23.

The disposition of the hydraulic cylinder end is regulated so that the cylinder may be raised or lowered while being pivoted at the riser itself. This degree of movement affords a greater degree of versatility to the overall system than would be realized were both ends of the hydraulic cylinders to be rigidly fixed.

Each vertically traversing carriage 34 includes a plurality of pulleys 46 and 47 mounted in tandem to a chassis 48 whereby to firmly fasten upon a hold-down cable 23. The respective pulleys are freely rotatable against and guided by the cable, the overall movement of the carriage being preferably regulated by means to be herein mentioned. The respective carriage segments are fastened into the common chassis 48 by a cross brace 49. The latter includes an end plate depending therefrom, which in turn supports coupling 44 directed toward the centrally positioned riser 28.

Hydraulic cylinder 32 is operably connected to the carriage 34 through pin connection 44 such that the cylinder is free to be pivotally moved about this connection as well as at the riser. The hydraulic cylinder can thus be raised or lowered at its remote end whereby to achieve maximum effectiveness thereof in acting against riser 28.

To fully utilize the versatility of carriage 34, it is preferably operably connected to a means for achieving the desired adjustment along the tensioning cables 23 in accordance with the configuration of the riser to be attained. In the present arrangement the control means includes an alignment cable 51 which is disposed coextensively with the respective pull-down cables 23. Said cable is further connected to wind-up means 52 at deck 11 for progressing the cable 51 to achieve a desired disposition of hydraulic piston 32.

Alignment cable 51 comprises in effect a continuous member, having the ends fastened to the respective upper and lower sides of carriage 34. Cable 51 is threaded through take-up mechanism 52 which is operable to wind or unwind the cable thus to progress carriage 34 in an upward or downward direction along cables 23.

Operationally, with tension leg platform 10 positioned for a normal operation at the floor of a body of water, riser 28 will be subjected to a certain amount of non-vertical distortion and deformation in response to the horizontal adjustment of the platform. Such horizontal movement occurs in spite of anchors 17, 18 and 19 and in response to the various water currents acting against the riser.

There are a number of ways wherein the riser configuration can be determined from appropriate instrumentation. Thereafter, a program can be determined for providing the riser with a desired configuraton to best promote drilling of a well. Such measuring equipment is known in the petroleum industry and can provide a relatively accurate reading such that the exact configuration of the riser will be known.

Since the tensioning cables 23 holding platform 10 beneath the water's surface are relatively straight and also canted from a normally vertical position, a determination is made regarding the adjustment of each individual riser adjustment member 32 to act against the riser at a particular angle.

With the riser configuration controlled, a drill string can be readily passed therethrough for an operation such as straight or directional drilling. Since, as mentioned, a plurality of rings 29, together with the outwardly radiating hydraulic adjuster 32 can be utilized at spaced apart intervals along the riser, a series of such adjusters can be individually utilized to achieve the desired pattern of the riser.

Other modifications and variations of the invention as hereinbefore set forth may be made without departing from the spirit and scope thereof, and therefore, only such limitations should be imposed as are indicated in the appended claims.

I claim:

1. In a tension leg marine structure for an offshore body of water, including means to apply a buoyant force to the structure, whereby to controllably regulate the floating disposition thereof in a body of water, anchor means at the floor of said body of water, including a plurality of anchors spaced about said floor in a predetermined pattern beneath said marine structure and tension cable means extending between said plurality of anchors and said structure respectively, said cable means being adjustable by applying tension thereto for establishing the floating disposition of said marine structure in the water, a riser extending between, and connected at its respective extremities to said structure, and to a connector means disposed at the ocean floor, and a riser adjustment system including a plurality of hydraulic cylinders connected to and extending between said tension cable means and said riser, said hydraulic cylinders having a piston operably contained therein, and control means including a source of hydraulic fluid communicating with said hydraulic cylinders, and valve means operable to direct the flow of hydraulic fluid through said hydraulic cylinders, whereby to adjustably regulate the horizontal spacing between said riser and said tension cable means.

2. In an apparatus as defined in claim 1, wherein said hydraulic cylinder includes means at opposed ends thereof to operably engage said riser to said tension cable means respectively.

3. In an apparatus as defined in claim 1, including means to controllably regulate the angular relationship between said riser and said hydraulic cylinder.

4. In an apparatus as defined in claim 1, including vertical alignment means depending from said tension cable means and adapted to engage a remote end of said hydraulic cylinder.

5. In an apparatus as defined in claim 4, including means for positioning said vertical alignment means a desired distance along said tension cables.

6. In an apparatus as defined in claim 1, including a carriage operably retained on said tension cable means, and means communicated with said carriage for vertically regulating the relative position thereof with respect to said riser.

7. In an apparatus as defind in claim 1, wherein said vertical alignment means includes a cable connected to said carriage for controllably adjusting the vertical position thereof with respect to said collar.

* * * * *